US007089748B2

(12) United States Patent
Tiemann

(10) Patent No.: US 7,089,748 B2
(45) Date of Patent: Aug. 15, 2006

(54) COMBUSTION CHAMBER, IN PARTICULAR OF A GAS TURBINE

(75) Inventor: Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 155 days.

(21) Appl. No.: 10/694,192

(22) Filed: Oct. 27, 2003

(65) Prior Publication Data

US 2005/0086945 A1 Apr. 28, 2005

Related U.S. Application Data

(63) Continuation-in-part of application No. PCT/EP02/04540, filed on Apr. 24, 2002.

(60) Provisional application No. 60/286,663, filed on Apr. 27, 2001.

(51) Int. Cl.
*F02C 7/20* (2006.01)
*F23R 3/50* (2006.01)

(52) U.S. Cl. ..... 60/800; 60/757

(58) Field of Classification Search ..... 60/757, 60/760, 800, 798, 752
See application file for complete search history.

(56) References Cited

U.S. PATENT DOCUMENTS 1,574,946 A 3/1926 Stevens
3,007,312 A * 11/1961 Shutts ..... 60/39.821
3,031,844 A * 5/1962 Tomolonius ..... 60/752
4,236,378 A * 12/1980 Vogt ..... 60/757
4,362,500 A * 12/1982 Eriksson et al. ..... 60/760
4,414,816 A * 11/1983 Craig et al. ..... 60/757
4,805,397 A 2/1989 Barbier et al.
4,819,438 A 4/1989 Schultz
4,912,922 A * 4/1990 Maclin ..... 60/757
5,062,249 A * 11/1991 Smagner ..... 110/336
5,326,206 A * 7/1994 Moore ..... 411/113
5,363,643 A * 11/1994 Halila ..... 60/752
6,085,515 A * 7/2000 Walz et al. ..... 60/757
6,675,585 B1 * 1/2004 Calvez et al. ..... 60/796

FOREIGN PATENT DOCUMENTS

DE 19623300 * 12/1997
DE 197 51 299 A 1 2/1999
EP 0 896 193 A2 10/1999
WO WO 99/47874 9/1999

* cited by examiner

*Primary Examiner*—Ted Kim

(57) ABSTRACT

The invention relates to a combustion chamber, in particular of a gas turbine, comprising an external wall structure that surrounds an internal area and an internal wall, which is formed by the surface of a housing that is located in the internal area. Said combustion chamber can be cooled essentially by convection by an air stream that flows between the external wall structure and the internal wall, whereby the air stream is conducted in a closed cooling air canal. The housing can be mounted in the internal area of the combustion chamber by means of a suspension device, which comprises a large number of fixing elements that are arranged on the periphery of the housing and are braced against the wall structure.

16 Claims, 9 Drawing Sheets

COMBUSTION CHAMBER, IN PARTICULAR OF A GAS TURBINE

CROSS REFERENCE TO RELATED APPLICATIONS

This application is a Continuation in Part of International Application No. PCT/EP02/04540, filed Apr. 24, 2002 and claims the benefit thereof. The International Application claims the benefits of U.S. provisional application No. 60/286,663 filed Apr. 27, 2001, both of the applications are incorporated by reference herein in their entirety.

FIELD OF THE INVENTION

The invention relates to a combustion chamber, in particular of a gas turbine, having an outer wall structure that surrounds an internal area, and an inner wall offset from the wall structure. The invention also relates to a suspension device for such a combustion chamber as claimed in the preamble of claim 10.

BACKGROUND OF THE INVENTION

Usually the surfaces of a combustion chamber exposed to the hot gas are cooled by means of impingement cooling, wherein the cooling medium used for cooling impinges practically vertically on a surface to be cooled. This type of cooling is very effective, but the cooling medium experiences a large pressure loss in the process as a result of the impingement on the surface to be cooled.

In a gas turbine, air taken from an air stream generated by a compressor is normally used as the cooling medium. If impingement cooling is the main cooling method employed here, then, owing to the large pressure loss occurring in the process, once cooling is complete, the air used in the process normally can no longer be used for the combustion because the mass flow rate of the cooling air is too low after the cooling. Thus once cooling is complete, the cooling air is no longer available for the combustion. This means there is no alternative but to accept a loss of air that typically ranges from 4 to 8% of the mass flow rate generated by a compressor. In addition, such a loss of air leads to a reduction in the efficiency of the turbine.

DE 197 51 299 C2 discloses a combustion chamber that has a wall structure surrounding an internal area and an inner wall offset from this wall structure.

An intermediate wall having orifices through which cooling steam passes for impingement cooling of the inner wall is also arranged in the intermediate area formed by the wall structure and the inner wall.

The combustion chamber is steam cooled, wherein the cooling steam enters an outer cooling area, passes from here through the orifices into an inner cooling area and there cools by impingement cooling the side of the inner wall not facing the hot gas.

The disadvantage here is that the cooling medium—cooling steam in this case—suffers a large loss in pressure as a result of the impingement cooling. If cooling air were to be used instead of cooling steam in the combustion chamber described, then the cooling air flow would no longer be usable for the combustion because of the large pressure loss.

SUMMARY OF THE INVENTION

It is therefore the object of the invention to specify a combustion chamber, in particular of a gas turbine, having a wall structure that surrounds an internal area, and an inner wall offset from the wall structure, that is easy to manufacture and, in particular, overcomes the disadvantages described.

The object is achieved according to the invention by a combustion chamber, in particular of a gas turbine, having an outer wall structure that surrounds an internal area, and an inner wall offset from the wall structure, wherein the inner wall is formed by the surface of a housing arranged in the internal area and said combustion chamber can be cooled essentially by convection by an air stream flowing between the outer wall structure and the inner wall, the air stream being conducted in a closed cooling air channel.

In this arrangement the surface of the housing and the outer wall structure form the cooling air channel, which, among other functions, prevents cooling air escaping directly into the combustion area of the combustion chamber.

In this respect it is a closed cooling system. The cooling air travels along the inner wall formed by the surface of the housing, cooling it by convection.

The air conducted in the cooling air channel can be fed directly through the burner, then taking an active part in the combustion process. Thus there is essentially only one defined outlet orifice for the cooling air out of the cooling air, namely in the region of the burner, in order to feed the cooling air to the burner.

With convective cooling, the loss in pressure of the cooling air is considerably lower than with impingement cooling. Thus the combustion chamber according to the invention overcomes the disadvantages of the prior art. Furthermore, conducting the cooling air in a closed cooling system avoids a loss in cooling air that arises from cooling air entering the combustion area of the combustion chamber directly.

In an advantageous embodiment of the invention, the housing is split in a maximum of one sectional plane. The housing is thus composed of at most two prefabricated sections.

In this way, when the housing is joined together, only one gap is created that needs to be sealed against the entry of cooling air into the combustion area located inside the housing in order to avoid air losses.

Advantageously, the housing is made of sheet metal, in particular having a wall thickness between 3 mm and 10 mm.

Sheet metal is a material that can be manufactured and processed economically and has a high heat resistance. The preferred range of sheet-metal wall thicknesses cited results in a particularly thin inner wall. Since convective cooling takes place in the combustion chamber according to the invention, the cooling air stream moving relatively slowly along the outer side of the inner wall, a thin inner wall is particularly advantageous because it can be cooled more easily by a slow convective air flow than a thicker inner wall.

In an advantageous embodiment of the invention, the housing extends from a burner projecting into the internal area to a hot gas outlet orifice in the combustion chamber.

In this advantageous embodiment of the invention, practically all of the sub-area of the internal area essential for the combustion is surrounded by the housing, and the cooling used according to the invention hence encompasses practically the whole combustion area, since this area is surrounded by the inner wall of the housing. Thus it is not necessary to provide additional cooling measures for other areas of the combustion chamber.

Advantageously, the housing is interlocked with the wall structure in the area of the hot gas outlet orifice.

During operation of the gas turbine, large temperature changes occur, in particular in the combustion chamber, which cause expansion and contraction of the housing in both the radial and axial directions with respect to an axis orientated in the lengthwise direction of the combustion chamber. The housing is hence to be arranged in such a way that the expansion and/or contraction described above is possible without damaging the combustion chamber. An interlocking joint is a mounting that is particularly easy to manufacture and also allows movement (expansion/contraction) of the interlocked structure: one edge of the sheet-metal housing, preferably the edge at the end where the hot gas outlet orifice is located, is provided with a radial flange (i.e. arranged essentially normal to the surface) that is inserted in a slot made in the wall structure. This interlocking joint is advantageously designed so that the slot is slightly wider than the flange so as to implement an interlocking joint with inherent play. Thus axial expansion or contraction of the housing as a result of temperature changes is possible in the area of the interlocking joint without damaging the interlocking joint. The interlocking joint also has the advantage of simultaneously achieving a seal between the housing and the wall structure.

In order to guarantee radial expansion of the housing, the flange advantageously comprises at least one slit so that the flange is no longer so rigid in the radial direction and can be reversibly deformed more easily; to maintain the seal of the flange, the slit should be provided with a seal.

Preferably, the housing is interlocked with the wall structure only in the area of the hot gas outlet orifice.

In a further advantageous embodiment of the invention, the wall structure has at least one cooling-air inlet orifice in the area of the hot gas outlet orifice.

Cooling air can be fed via these orifices into the cooling air channel formed by the inner wall and the wall structure. At the point at which the cooling air enters the airway, the section of the housing located there is cooled by impingement cooling. All other sub-areas of the inner wall are convectively cooled by the cooling air traveling along the outer face of the inner wall after entering the cooling air channel.

Advantageously, the housing has stiffening ribs on its surface.

The stiffening ribs not only improve the rigidity of the housing but also serve as cooling fins. Advantageously, the stiffening ribs are arranged in an axial direction on the surface of the housing. The height and width of the ribs can be designed so that only low stresses arise.

In a further advantageous embodiment of the invention, in the area of the burner the housing has a device for insertion of the burner.

The burner is an essential component of the combustion chamber and hence it should be possible to arrange it as easily and flexibly as possible. A device for insertion of the burner is particularly suitable for this purpose, said device being a part of the combustion chamber according to the invention. A separate burner insert that is pushed into the device for insertion of the burner can also be provided as a receptacle for the burner.

In a further advantageous embodiment of the invention, the housing is suspended on the wall structure by means of a suspension device.

A suspension device is a particularly suitable means of arranging the housing in the combustion chamber. When the housing is suspended in the combustion chamber, then an intermediate area forming the cooling air channel is created between the surface of the housing and the wall structure. The design of the suspension device can hence also have an effect on the form of the cooling air channel. Furthermore, the suspension device allows expansion and/or contraction of the housing with changes in temperature.

Advantageously, the suspension device is formed by a plurality of fixing elements that are arranged around the perimeter of the housing and connected to the wall structure under tension.

By applying a tension to the fixing elements, the position of the housing within the combustion chamber is stabilized. By arranging a plurality of fixing elements around the perimeter of the housing surface, the forces acting on the housing are distributed particularly uniformly.

Advantageously, the fixing elements are spring mounted at the end adjoining the wall structure.

The spring mounting serves not only to provide a tension, but also to damp vibrations that the housing is subject to, for example when loads change during operation of the turbine and/or as a result of temperature fluctuations.

It is particularly advantageous if the suspension device is designed such that the suspended housing can move both axially and radially with respect to an axis running in a lengthwise direction of the combustion chamber.

In this way it is ensured that thermal expansion or contraction of the housing is possible in practically all directions without the suspension device and/or the combustion chamber being damaged. Since large temperature changes occur very frequently during operation of the turbine, it is necessary to provide a possibility for expansion or contraction of those parts of the gas turbine that come into contact with the hot gas. It should be taken into account here that despite creating a possibility of expansion or contraction, those parts of the turbine involved must be guaranteed to be sealed against loss of gas, cooling air and/or steam in order to ensure steady operation of the turbine and high efficiency.

In a further advantageous embodiment of the invention, the fixing elements comprise bolts, each of which have at a first end an essentially hemispherical bolt head that is seated so as to allow tilting in a recess in a bolt holder mounted on the housing end, said recess being essentially hemispherical in cross-sectional view.

The bolt holder, which is mounted on the housing end, is preferably a U-shaped fastening welded onto the housing.

Owing to the hemispherical shape of both the recess of the bolt holder and the bolt head, a seating is created that allows tilting of the bolt in particular. Such tilting actions occur in particular during movements of the housing suspended in the combustion chamber caused for example by temperature changes.

Advantageously, the second end of each bolt is fed through a guide hole in the wall structure and through a compression spring on the outer side of the wall structure, the compression spring being compressed against the outer side of the wall structure by means of a washer held at the second end of the bolt.

In this embodiment, a compression spring provides the tension under which the housing is connected to the wall structure. Compression springs are also particularly suitable, low-cost and versatile spring elements that can be used to provide both tension and damping.

It is particularly advantageous if the guide hole, viewed in cross-section, has a narrowing which damps radial and/or axial movement of the housing.

The guide hole is preferably wider than the bolt thickness so that the bolt can be fed through the guide hole easily. If the bolt then moves with the housing as a result of temperature changes for example, then such a guide hole makes little contribution to deliberate damping of these movements and hence to the rigidity of the combustion chamber; this is why the guide hole is narrowed in this advantageous embodiment, so that the bolt which moves in the guide hole rubs against the narrowing, thereby damping movements and/or vibrations of the housing by friction.

In a combustion chamber according to the invention (annular combustion chamber), individual combustion chambers (cans) can also be provided, distributed around the perimeter of the combustion chamber, each forming a separate combustion chamber for a burner arranged in each one. This reduces in particular the noise generation during operation of the gas turbine because the individual contributions from the burners to the overall noise generation are decoupled from each other and no noise vibrations can build up. Furthermore, the individual combustion chambers can each have an inner housing similar to the construction of the combustion chamber according to the invention.

Thus in a further advantageous development of the invention, a combustion chamber is obtained that is connected to at least one individual combustion chamber, the housing of the combustion chamber being connected to at least one inner housing of an individual combustion chamber in such a way that during operation of the combustion chamber the thermal expansion component of the inner housing in the radial direction is essentially equal to the thermal expansion component of the housing in the radial direction.

In this way it is ensured that cooling air used to cool the housing of the combustion chamber and/or inner housing of the individual combustion chambers does not escape accidentally into the interior area of the combustion chamber through a gap formed at the joint between housing and inner housing, and so is not lost to the combustion.

In a further advantageous development of the invention, the housing is supported in the area of a hot gas outlet orifice and in the area of a burner installation receptacle.

During operation of the gas turbine, the housing is subject to deformations caused by the thermal expansion forces that arise. This means that the housing expands and/or contracts both with respect to its longitudinal orientation and across its width (radial direction).

In order to permit said thermal expansion movements, the housing is suspended in a self-supporting arrangement, i.e. only supported in the area of a hot gas outlet orifice and in the area of a burner installation receptacle. Thus the housing can swing freely between said supports, taking up movements of the housing.

The burner installation receptacle is advantageously designed as an inner housing of an individual combustion chamber or as a burner receptacle, in particular as a burner slide-in receptacle.

The given embodiments for the burner receptacle take into account both the embodiment of the combustion chamber according to the invention as a simple annular combustion chamber, and as an annular combustion chamber having individual combustion chambers (cans) attached to it. If the combustion chamber is implemented as a simple annular combustion chamber, then the burner installation receptacle is designed as a burner receptacle, i.e. the burner is arranged in such a way that it is introduced directly into the annular combustion chamber. Where the combustion chamber according to the invention is implemented as an annular combustion chamber connected to individual combustion chambers, the burner installation receptacle is designed as an inner housing of each individual combustion chamber. In both cases, the housing is therefore suspended in a self-supporting arrangement.

Advantageously, the surface of the housing is curved.

The use of a curved housing surface, in particular manufactured by forging, increases the inherent rigidity of the housing, so that even a small thickness for the housing is sufficient to ensure its rigidity.

In a further advantageous embodiment of the invention, the housing consists of a number of housing sections, in particular of a number of groups of housing sections each comprising four housing sections. The housing sections have longitudinal ribs extending essentially over their entire length, which, when viewing the exposed edge of each longitudinal rib from above, run practically in a straight line.

The use of longitudinal ribs on the housing or housing surface increases the rigidity of said sections. In addition, said longitudinal rib can be used to secure the position of the housing inside the gas turbine combustion chamber. The use of a plurality of housing sections has the advantage, for example, that when repairing the housing, only the housing sections to be replaced need to be removed and changed rather than the complete housing.

Advantageously, the longitudinal ribs are each inserted in corresponding negatively shaped longitudinal slots in the wall structure.

In this way, the housing sections are held in position particularly easily by the longitudinal ribs, one of whose functions is to increase the rigidity of the housing sections, doubling as guide ribs inserted in longitudinal slots in the wall structure.

It is particularly advantageous when the housing sections have circumferential ribs, which, when viewing the exposed edge of each circumferential rib from above, run in a curved path.

Advantageously, the circumferential ribs are each inserted in corresponding negatively shaped circumferential slots in the wall structure.

Movements in the circumferential direction, for example, are taken up by the circumferential ribs so that the housing sections cannot move arbitrarily in the circumferential direction. The embodiment described also has the advantage that the housing composed of a plurality of housing sections can be dismantled particularly easily because the housing sections can be dismantled and removed from the end for a burner installation receptacle without having to open up the external wall structure. This is possible because the housing sections with their circumferential ribs running in a curved path are inserted in circumferential slots inclined at correspondingly different angles in the wall structure, so that the housing sections can be pulled out easily from the end for a burner installation receptacle.

BRIEF DESCRIPTION OF THE DRAWINGS

Four exemplary embodiments of the invention are shown in more detail below, in which.

DETAILED DESCRIPTION OF THE INVENTION

Figure 1:
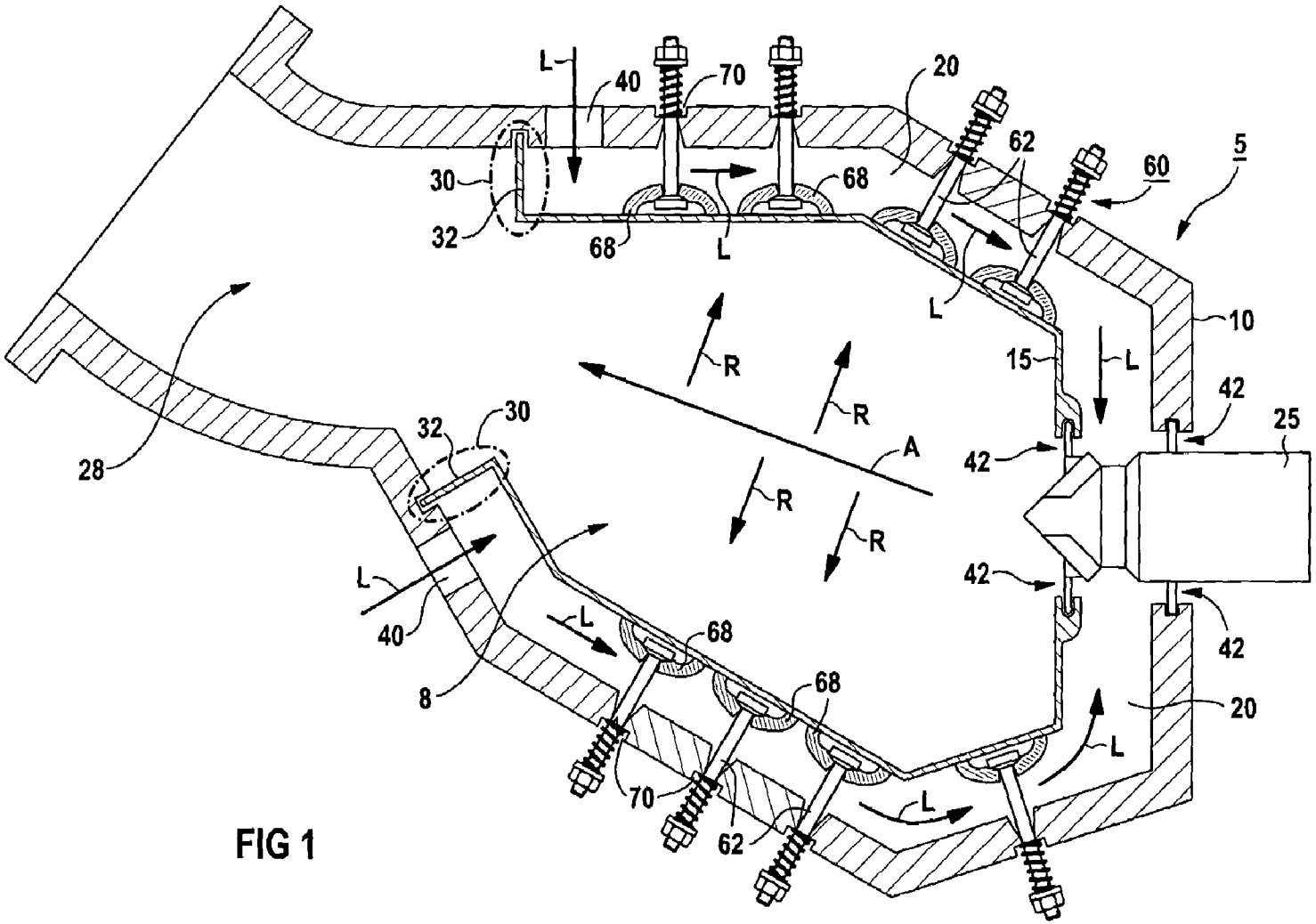
FIG. 1 shows a longitudinal section through a combustion chamber according to the invention.

FIG. 1 shows a combustion chamber 5 in longitudinal section. A wall structure 10 forms an outer shell of the combustion chamber and surrounds an internal area 8.

The internal area 8 is also surrounded by a housing 15, whose housing jacket is offset from the wall structure 10, so that a cooling air channel 20 is formed between the wall structure 10 and the housing 15.

The housing 15 is connected to the wall structure 10 in this exemplary embodiment in two different ways:

An interlocking joint 30 holds in position the section of the housing 15 located in the area of a hot gas outlet orifice 28. In addition, the housing 15 is connected to the wall structure 10 by means of a suspension device formed from a plurality of fixing elements 60. These fixing elements 60 are preferably distributed uniformly over the surface of the housing 15 both in the axial direction A and in the radial direction R, and are fed through guide openings 70 in the corresponding positions in the wall structure 10. A fixing element as part of the suspension device is shown in more detail in FIG. 3.

The combustion area of the combustion chamber 5 according to the invention is located inside the housing 15. The combustion is maintained by a burner 25 that projects into the internal area 8. In the present embodiment, the burner 25 is placed in a burner insertion device 42. Here the burner insertion device 42 may be designed as a slide-in receptacle, for example, so that the burner 25 can easily be pushed into the combustion chamber and out again.

During operation, the combustion chamber 5 according to the invention is cooled essentially by convection. A cooling-air stream L entering the cooling air channel 20 through cooling-air inlet orifices 40 in the wall structure 10 travels along the surface of the housing 15 and thereby cools by convection the wall of the housing 15 exposed to the hot gas on its side facing away from the hot gas. The cooling air L is conducted through the burner 25, where it actively promotes the combustion as a supplier of oxygen; thus there is essentially only one defined outlet orifice for the cooling air out of the cooling air channel, namely at the position of the burner, in order to feed the cooling air to the burner. Impingement cooling takes place practically only directly after the cooling air stream L has entered the cooling air channel 20 through the cooling-air inlet orifices 40, when the cooling air stream L impinges practically vertically on that part of the surface of the housing 15 located there. By far the largest proportion of the surface of the housing 15 is not cooled by impingement cooling, but by convection by the cooling air stream L, which travels along the housing surface in parallel with it, thereby removing heat from it.

A major advantage of the combustion chamber according to the invention lies in the fact that owing to the closed cooling used, not only is air loss prevented because the cooling air cannot escape directly into the combustion chamber, but also, owing to the principle of convective cooling employed in the combustion chamber according to the invention, only slight loss of pressure occurs during the cooling process, so that there is practically no negative impact on the efficiency of the turbine.

The housing 15 is preferably made of sheet metal having a wall thickness in the range 3 mm to 10 mm. This is a relatively thin inner wall formed by the surface of the housing 15, one side of said inner wall being exposed directly to the hot gas. Such a thin inner wall can be cooled well by a relatively slow, convective cooling air L, because the thermal capacity of a thin wall is less than that of a thicker wall, and thus even a slow cooling air stream is sufficient.

The housing 15 is advantageously split just once (i.e. in one sectional plane) so that when the two sections of the housing are joined together there is only one gap that needs to be sealed against the entry of cooling air L into the internal area 8 or against the escape of hot gas out of the internal area 8 into the cooling air channel 20. An almost optimal reduction in cooling-air loss and pressure loss is achieved in this way.

The inner surface of the housing 15 facing the hot gas is advantageously provided with a layer of thermal insulation, thereby further improving the cooling of the housing.

Considerable temperature changes occur during operation of the combustion chamber 5, with the result that the housing 15 in particular, whose inner surface is in direct contact with the hot gas, expands or contracts in both the axial direction A and the radial direction R as a function of the current operating temperature of the combustion chamber 5. The aforementioned interlocking joint 30, which includes a flange 32 inserted in a slot in the wall structure 10, has the advantage both that cooling air channel 20 at the location of the flange is sealed against loss of cooling air, and also that the housing 15, while being held in position in the area of the interlocking joint 30, can still expand and/or contract both in the axial direction A and in the radial direction R. Thus the interlocking joint 30 ensures practically a rest position of the housing 15, without it restricting the necessary expansion possibilities of the housing 15 during operation.

The cooling air flow rate and hence the velocity of the cooling air stream L can be influenced by the size of the cooling-air inlet orifices 40.

Figure 2:
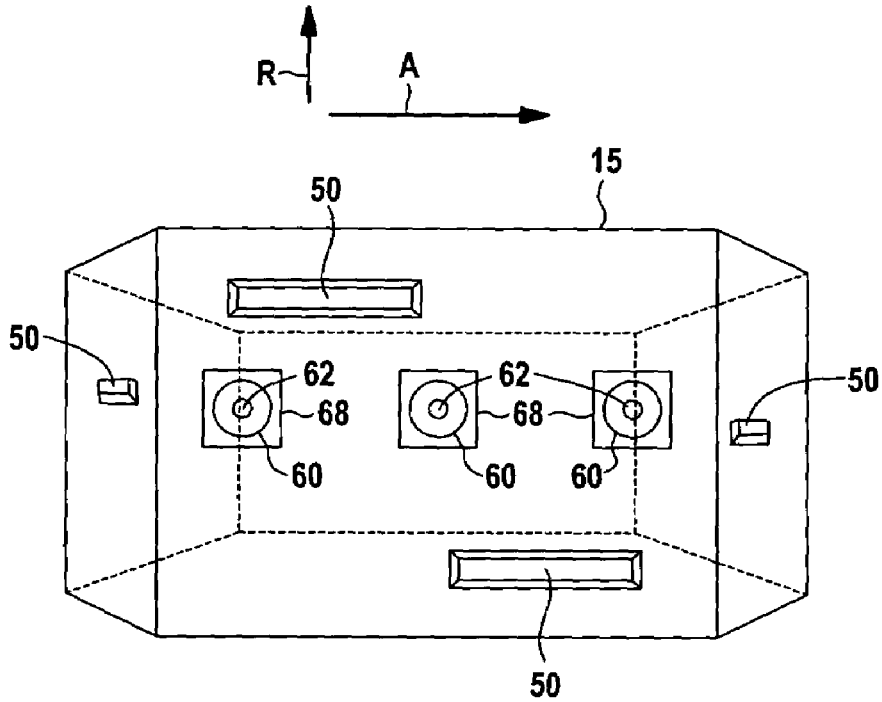
FIG. 2 shows a plan view of a sub-area of the surface of the housing of a combustion chamber according to the invention.

FIG. 2 shows a plan view of a sub-area of the surface of the housing 15 of a combustion chamber according to the invention, where the wall structure 10 has not been shown.

To stiffen the housing 15, stiffening ribs 50 are provided which are preferably arranged on the surface of the housing in axial direction A. The height and width of the stiffening ribs 50 are designed to avoid any excessive stresses arising. Apart from contributing to improving the rigidity properties of the housing 15, the stiffening ribs 50 also contribute to improved cooling of the housing 15, because during operation of the combustion chamber they act as cooling fins, with cooling air traveling past them and dissipating heat.

Fixing elements 60 are also located on the sub-area shown of the surface of the housing 15.

The fixing elements 60 comprise bolts 62 which, at the end located at the surface of the housing 15, are seated in bolt holders 68. More details are shown in FIG. 3 below.

Figure 3:
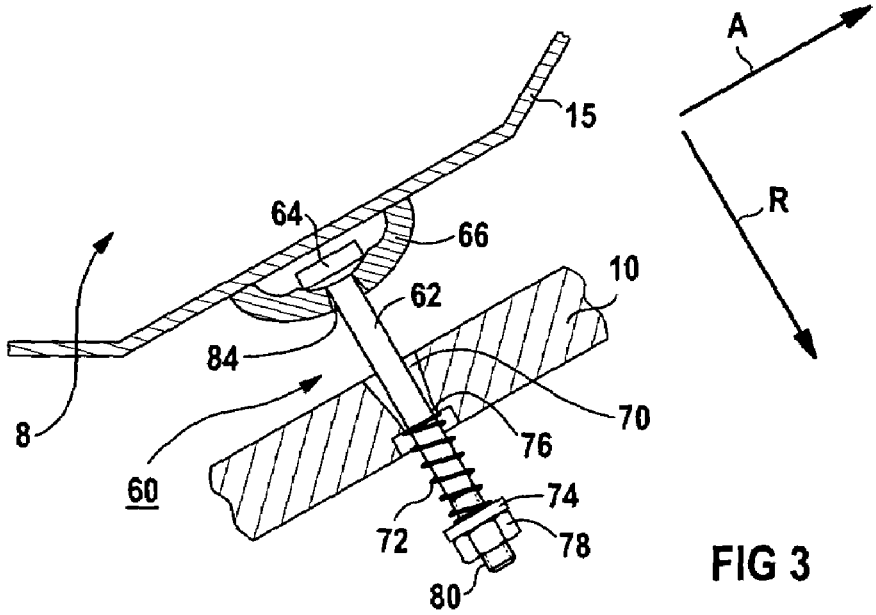
FIG. 3 shows a fixing device as part of a suspension device for a combustion chamber according to the invention.

FIG. 3 shows a detailed view in particular of a fixing element 60 that can be used in the suspension device according to the invention. The fixing element 60 together with the housing 15, bolt holder 68 and the wall structure 10 are shown here in longitudinal section.

Bolt holders 68 are mounted, in particular welded, onto the surface of the housing 15 not facing the hot gas, and the bolts 62 are seated in these.

The figure shows just one fixing element from the plurality of fixing elements of the suspension device according to the invention.

The bolt holder 68 has a recess 66 that is essentially hemispherical in shape. A bolt head 64 of a bolt 62 is fed through a hole in the bolt holder 68. The bolt head 64 is located with a form-fit in the recess 66 so as to allow tilting of the bolt.

The wall structure 10 has guide holes 70, the shafts of the bolts 62 projecting through these beyond the wall structure 10 into an outer area 82. In the outer area 82, the bolts 62 are fed through compression springs 72, which provide a tension for the suspension device and hence guarantee its rigidity while simultaneously permitting movements of the housing 15, especially in radial direction R, which occur in particular with temperature changes.

The compression of the compression spring 72 is set by a washer 74 which is fixed in a desired position by a nut 78 on a thread 80 of the bolt 62.

The guide hole 70 preferably has a narrowing 76 in its diameter. As a result of the narrowing 76, vibrations arising from movement of the housing 15, especially in radial direction R, are damped by the bolt 62 rubbing against the narrowing 76, thereby suppressing unwanted vibration of the housing 15. The compression spring 72 can be inserted in a recess of the wall structure 10 and hence secured in position.

The fixing element 60 shown in detail in FIG. 3 is particularly suitable for use with a suspension device according to the invention.

A multiplicity of such fixing elements 60 are used, each spring-mounted to tension the housing 15 against the wall structure 10. The bolt holders 68 are preferably U-shaped. The hemispherical recesses 66 of the bolt holders 68 mean that axial movements A of the housing 15 are possible, because the hemispherical bolt head 64 can perform movements in axial direction A in the hemispherical recess 66. In this case a hole 84 having a diameter larger than the diameter of the shaft of the bolt 62 is particularly advantageous.

Preferably, the guide hole 70 is also designed so that the shaft of the bolt 62 can move in it in axial direction A.

Movements of the housing 15 in radial direction R are damped by the compression spring 72.

The bolt head 64 can be flattened on two opposite sides so that it can be inserted particularly easily into the bolt holder 68 through the hole 84. If the bolt 62 is then rotated through 90°, it hence cannot slip out of the bolt holder 68 through the hole 84. To prevent accidental rotation of the bolt 62, a rotation locking device should advantageously be provided on the end located at the wall structure 10. The bolt 62 can thus be easily inserted or released during maintenance, for example, without the fear of accidental release of the bolt during operation of the combustion chamber, for instance as a result of vibrations of the bolt.

A suspension device according to the invention for a combustion chamber according to the invention achieves a stable rest position of the housing 15 by means of the tensions of the fixing elements set using springs. During operation of the combustion chamber, the movements of the housing 15 both in axial direction A and radial direction R arising particularly from temperature changes are allowed, so that the housing is not damaged by excessive stresses. These movements are also damped, preventing too large an amplitude of movement, which can destroy the housing. Thus a good compromise between rigidity and flexibility is achieved.

Figure 4:
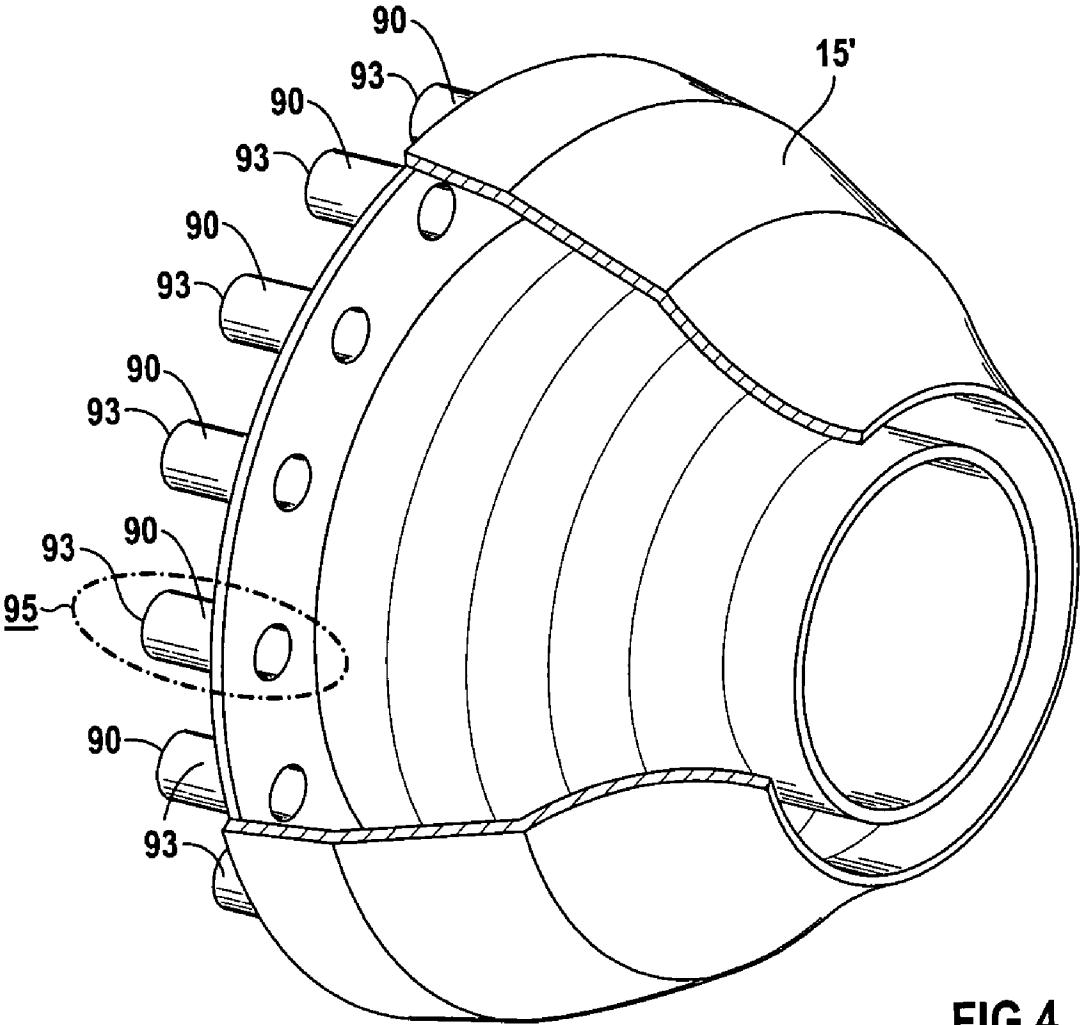
FIG. 4 shows a combustion chamber according to the invention that is connected to a number of individual combustion chambers.

FIG. 4 shows a housing 15' of a combustion chamber according to the invention, said housing being connected to a number of individual combustion chambers 93.

Each of the individual combustion chambers 93 is surrounded by an inner housing 90 and, not shown in the figure, an outer housing surrounding the inner housing. The support structure for the combustion chamber according to the invention is also not shown in FIG. 4. The details of a connection 95 between the housing 15' and an individual combustion chamber 93 are shown in more detail in FIG. 5 including the cooling air channel according to the invention.

The individual combustion chambers 93 provide a separate combustion area for each burner to be inserted in the individual combustion chambers, so that the total combustion, which is maintained by the sum of the burners, is as free as possible from unwanted coupling effects between the individual burners (for example those of noise generation).

Figure 5:
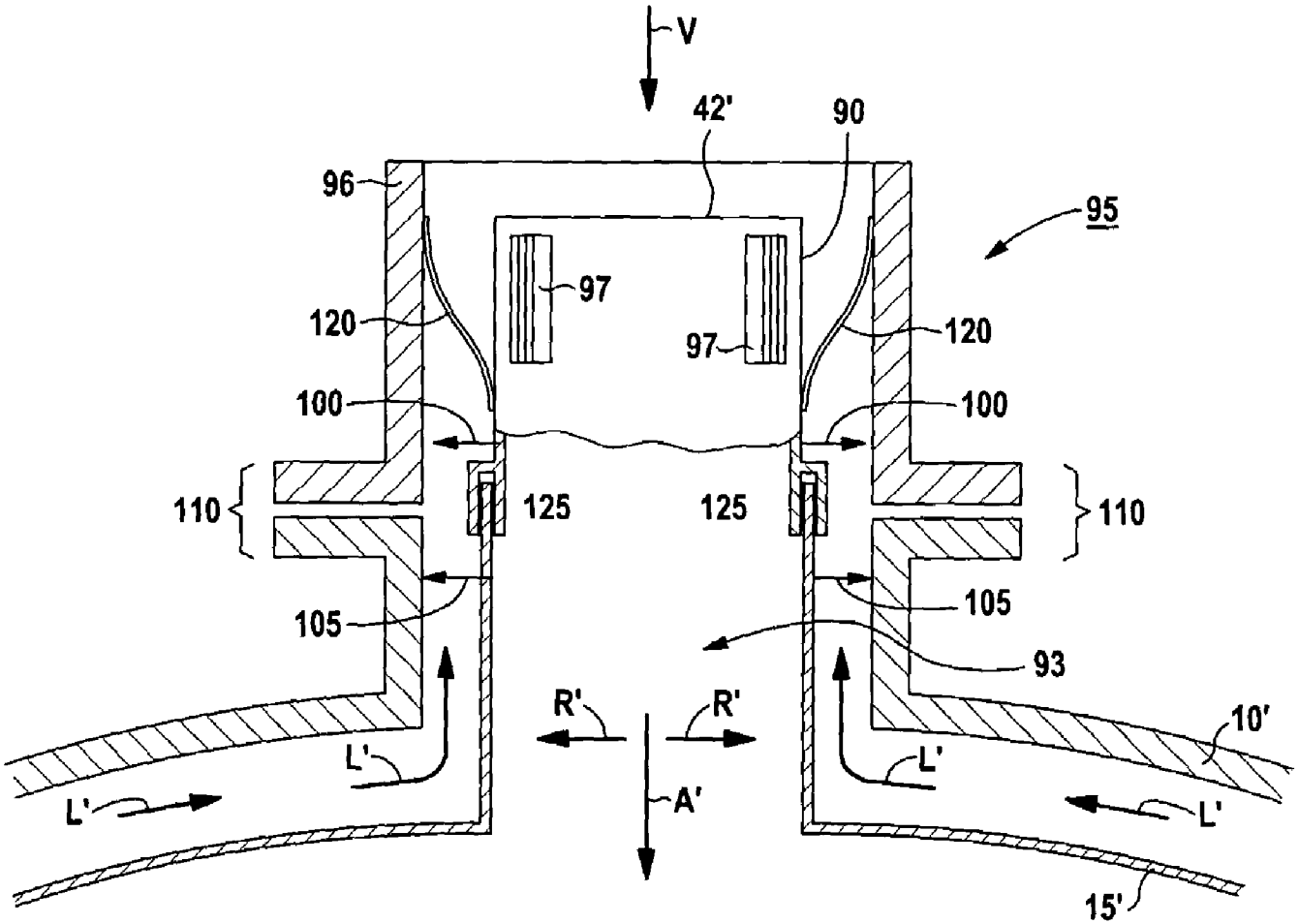
FIG. 5 shows a detailed view of a combustion chamber according to the invention connected to an individual combustion chamber.

The connection 95 between the combustion chamber according to the invention and an individual combustion chamber 93 is shown in detail in FIG. 5.

The individual combustion chamber 93 is surrounded by an inner housing 90, which in turn is surrounded by an outer housing 96. The latter is, for example, connected to the wall structure 10' of the combustion chamber by means of a flange connection 110. The inner housing 90 is advantageously connected to the housing 15' by means of a tongue-and-groove joint 125, so that play in direction A' is maintained, allowing the inner housing 90 to expand in direction A' as a result of thermal expansion of the inner housing occurring during operation.

The inner housing 90 of the individual combustion chamber 93 also has a burner insert 42' for holding a burner (not shown).

Furthermore, the inner housing 90 is connected to the outer housing 96 so as to allow movement in orientation A' by means of a plurality of slide-in receptacles 97.

In order to stabilize the position of the inner housing 90, support elements 120 are provided that preferably run at an angle from the outer housing 96 to the inner housing 90, and which particularly advantageously damp expansion of the inner housing 90 in radial direction R'. The support elements 120 can be welded onto the respective housing either at the end adjoining the outer housing 96 or at the end adjoining the inner housing 90, or at both of said ends. It is particularly advantageous when the cooling air stream L' can flow through the supporting elements 120, so that cooling of both the combustion chamber according to the invention and the individual combustion chambers is provided by the cooling air stream L'; the supporting elements can have a fork-shaped design for this purpose, for example, so that the cooling air stream L' can flow essentially unhindered through the prongs of the fork-shaped supporting elements.

The orientation A' of the individual combustion chambers is advantageously arranged such that the thermal expansion both of the housing 15' and of the inner housing 90 occurs as far as possible in direction A', and only a small proportion of each occurs normal to this in direction R'. In such an embodiment, the thermal expansion component 100 of the inner housing 90 in direction R' is practically equal to the thermal expansion component 105 in direction R' of the housing 15' (where both components are relatively small as already mentioned). Thus, during operation, thermal expansions mainly occur in direction A', which are allowed by the simple to implement tongue-and-groove joint 125. In addition to their simple implementation, a feature of tongue-and-groove joints is that they can be made practically airtight, thus preventing the undesirable situation of some of the cooling air stream L' entering the individual combustion chambers 93 and hence being lost to the combustion.

Like the tongue-and-groove joint 125, the flange connection 110 can very easily be made airtight, with the result that the cooling air stream L' can be fed practically without losses to the burner (not shown) of the individual combustion chamber 93, so that the cooling air stream L' takes an active part in the combustion.

The supporting elements 120 can, for example, have a fork-shaped design and be made of sheet metal. In this way, the cooling air stream L' can pass through the supporting elements 120 without significant obstructions, and be fed practically without loss of pressure to the burner of the individual combustion chamber.

Figure 6:
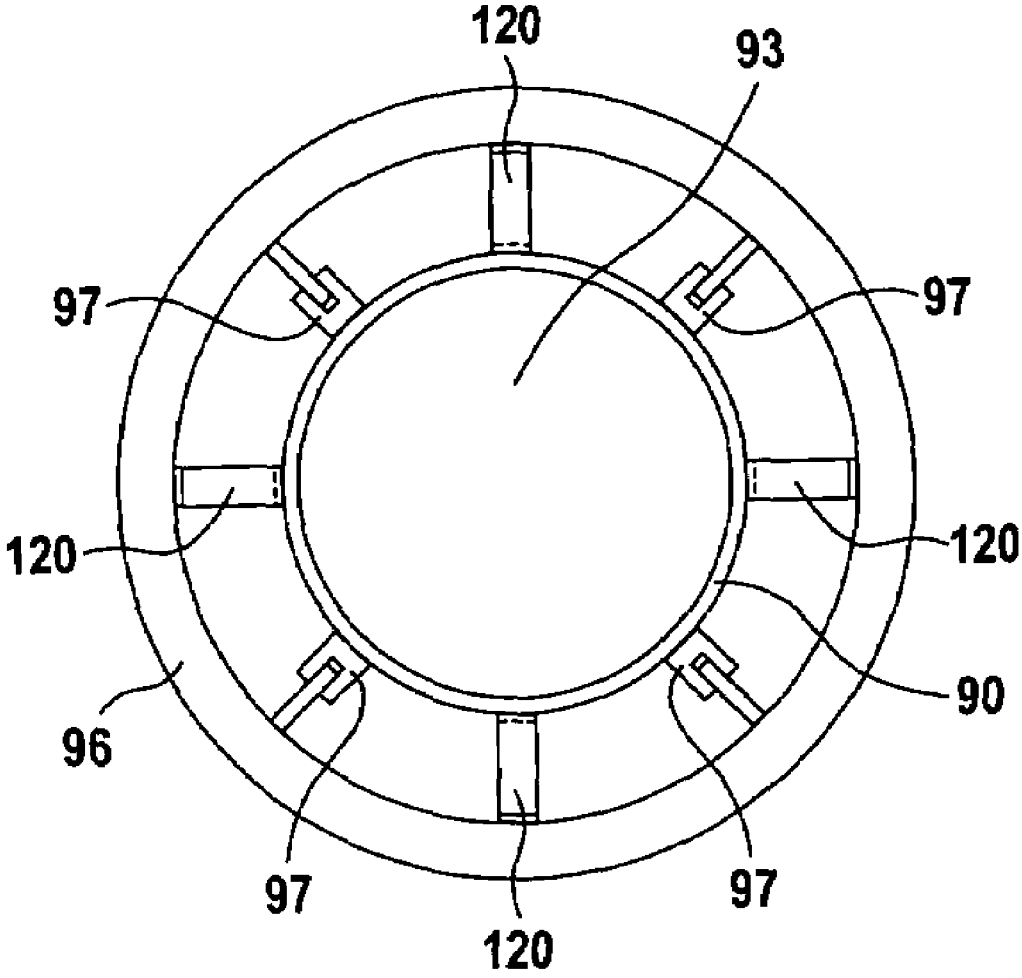
FIG. 6 shows a plan view of the individual combustion chamber of FIG. 5.

FIG. 6 shows a plan view of the inner housing 90 of an individual combustion chamber 93 from FIG. 5.

The inner housing 90 is surrounded by an outer housing 96. The inner housing 90 is connected to the outer housing by means of a slide-in seating 97 allowing movement in the direction of the longitudinal axis of the inner housing. In order to stabilize the orientation of the inner housing 90, supporting elements 120 are provided that are fixed, for example welded, at the end adjoining the outer housing and/or at the end adjoining the inner housing. The supporting elements 120 are preferably bent sheet metal, which in an advantageous embodiment have a fork-shaped design, so that a cooling air stream can flow through the supporting elements practically unhindered, i.e. without loss of pressure, through the prongs of such a fork shape. The supporting elements and/or the elements of the slide-in seating 97 are preferably arranged in pairs on opposite sides of the inner housing 90.

Figure 7:
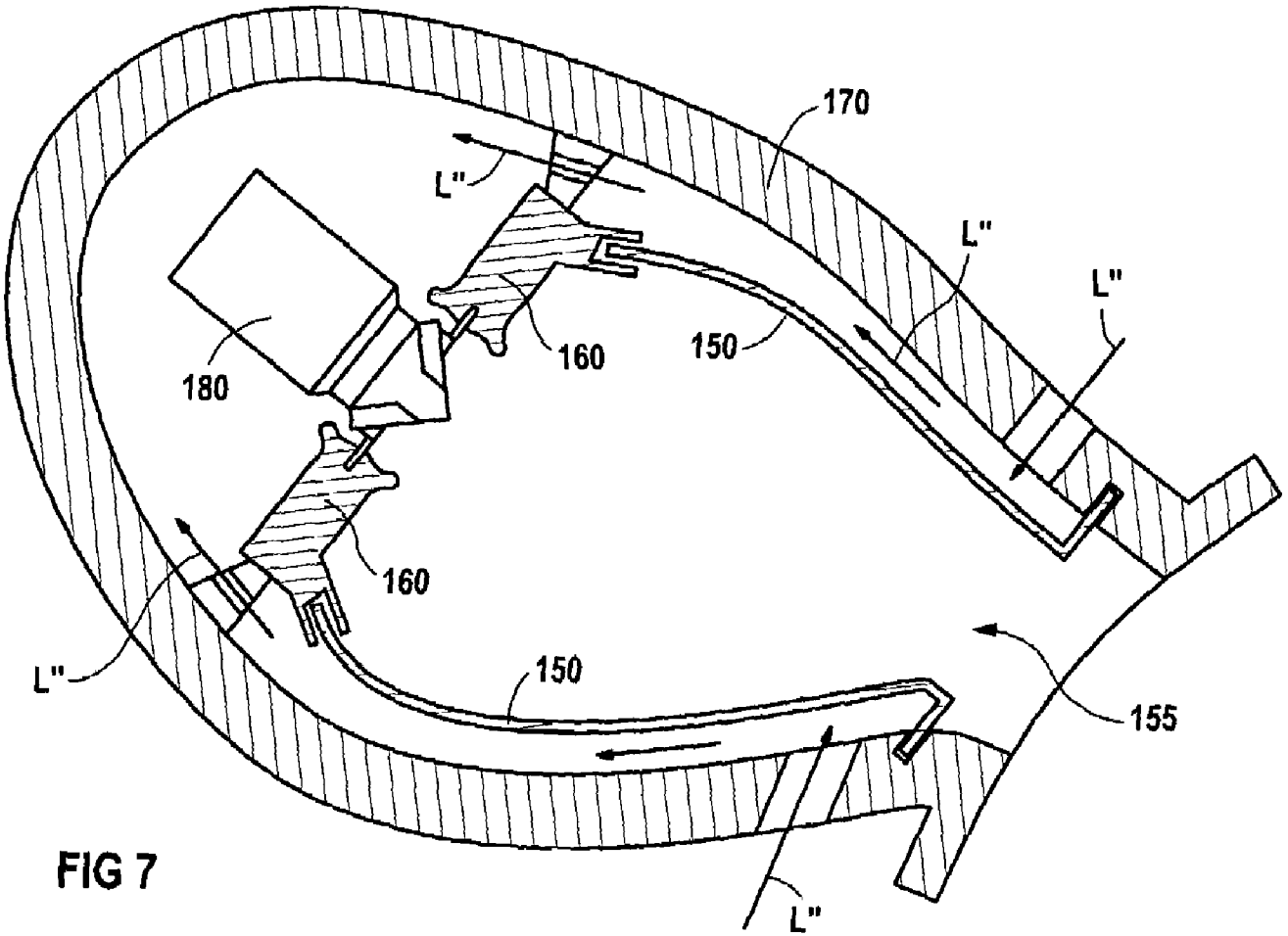
FIG. 7 shows a combustion chamber according to the invention having a self-supporting housing.

FIG. 7 shows a preferred embodiment of a combustion chamber according to the invention, the housing 150 being suspended in a self-supporting arrangement. This means that it is only supported in the area of a hot gas outlet orifice 155 (by means of an interlocking joint for example) and in the area of a burner installation receptacle 160 (by means of a tongue-and-groove joint for example). The housing can move freely between the two supports so that the housing 155 can perform thermal expansion movements, for instance, unhindered.

A cooling air stream L", which enters through air inlet orifices in the wall structure 170, travels along the surface of the housing 150 facing the wall structure 170, and cools said surface convectively. The cooling air stream L" can also pass through orifices, for instance holes, in the burner installation receptacle 160, and be fed to a burner 180 to take active part in the combustion. In this exemplary embodiment of the invention, the burner is inserted directly in the combustion area inside the housing 150.

Figure 8:
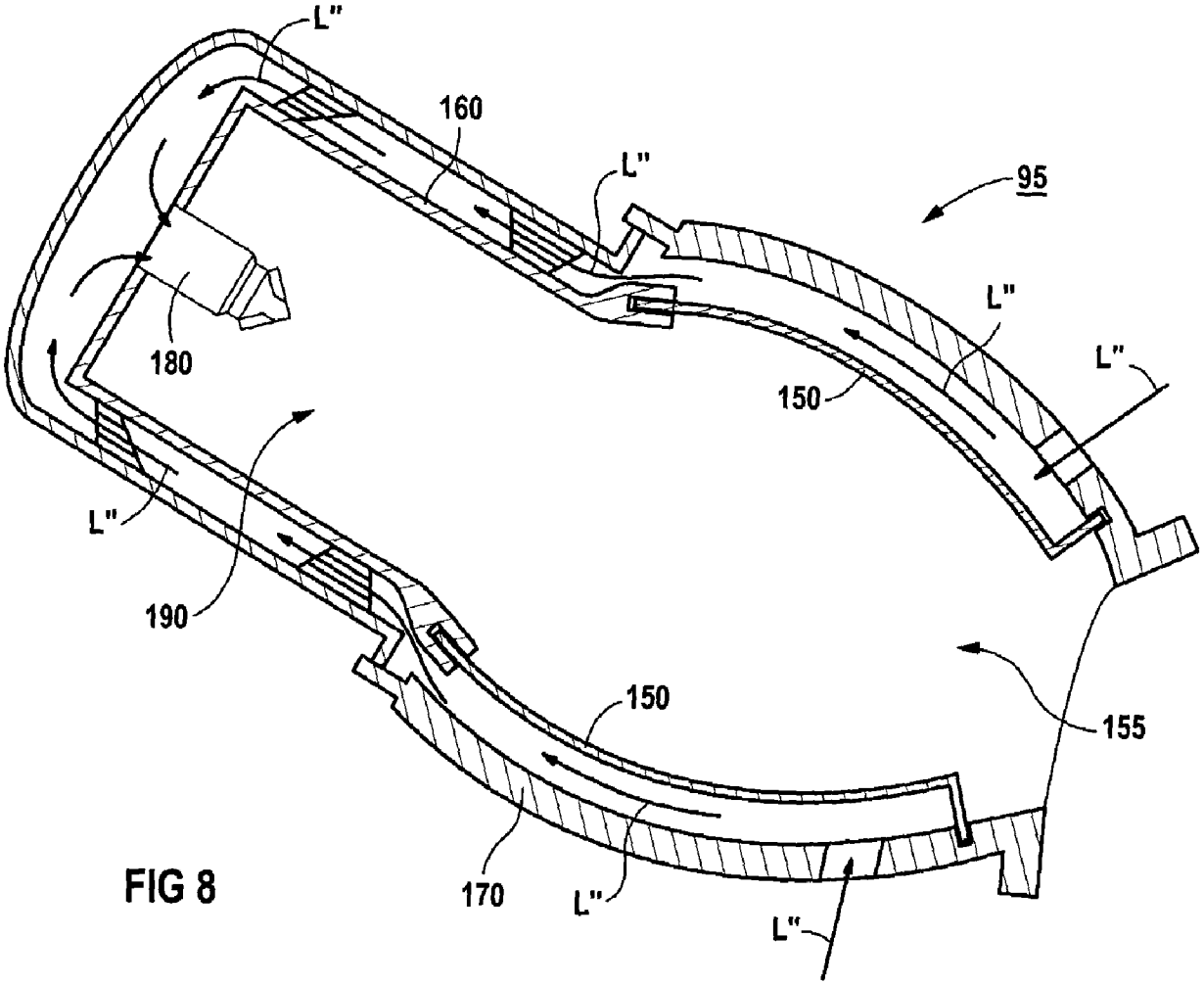
FIG. 8 shows a combustion chamber according to the invention having a self-supporting housing, said combustion chamber being connected to an individual combustion chamber.

FIG. 8 shows an exemplary embodiment of the invention in which a housing 150 of a combustion chamber according to the invention is connected to a burner installation receptacle 160 that is designed as an inner housing of an individual combustion chamber 190. The housing 150 is in this case also only supported in the area of a hot gas outlet orifice 155 and in the area of a burner installation receptacle 160, for example by an interlocking joint and a tongue-and-groove joint respectively. The housing can move freely between these two supports, so that the housing 55 can perform thermal expansion movements, for instance, unhindered. A cooling air stream L" is introduced through orifices in the wall structure 170 and travels along the side of the surface of the housing 150 facing the wall structure 170, cooling it by convection.

In this exemplary embodiment of the invention, the burner 180 is not inserted directly in the internal area of the housing 150, but is arranged in an individual combustion chamber 190 that is surrounded by an inner housing.

Figure 9:
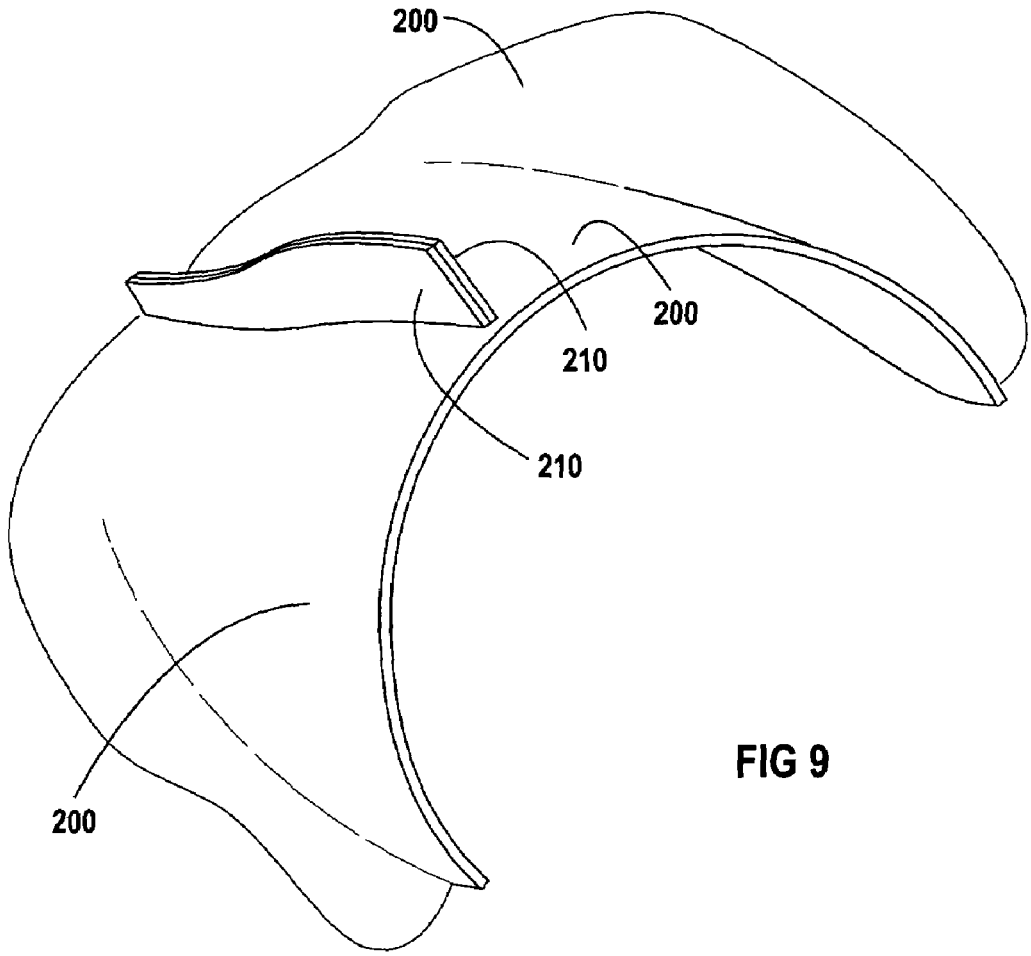
FIG. 9 shows a housing of a combustion chamber according to the invention, said housing consisting of a plurality of individual parts.

FIG. 9 shows the individual parts 200 of a housing of a combustion chamber according to the invention, where the housing sections 200 have longitudinal ribs 210 for increasing their rigidity. These longitudinal ribs 210 can be inserted into a slot made with a corresponding negative shape in the wall structure. In addition, the housing sections 200 have curved circumferential slots (not shown in more detail; see FIG. 10 for details), which take up movements of the housing in the circumferential direction, for example, and which can be inserted in slots made with corresponding negative shapes in the wall structure.

Figure 10:
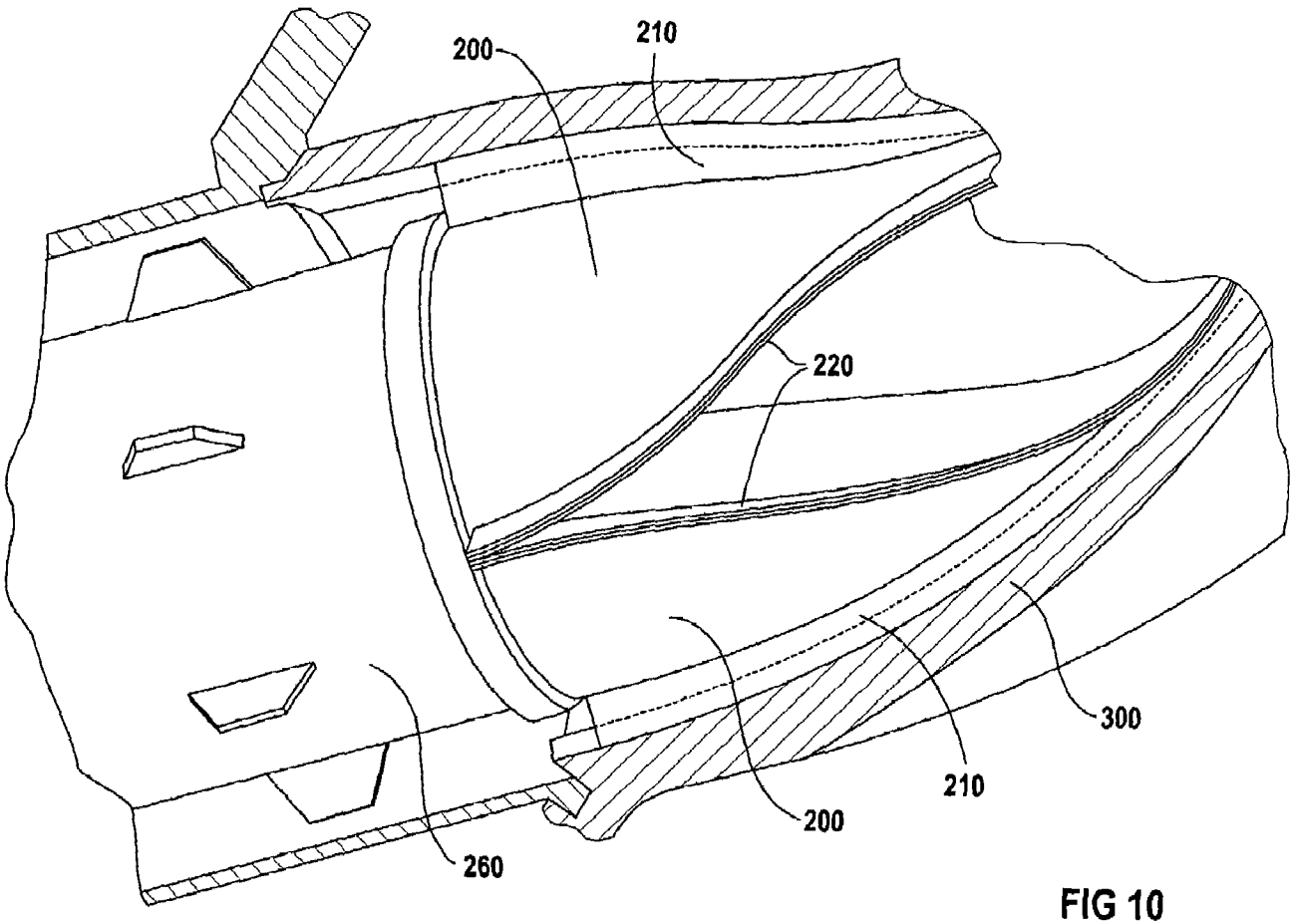
FIG. 10 shows a housing of a combustion chamber according to the invention connected to an individual combustion chamber, said housing consisting of a plurality of individual parts.

FIG. 10 shows a housing of a combustion chamber according to the invention consisting of a plurality of housing sections, which is connected to an individual combustion chamber 260.

An inner housing 260 of an individual combustion chamber is connected, for example by means of a tongue-and-groove joint, to four housing sections 200 having the design as shown in FIG. 9, as can be seen in FIG. 10. The housing sections 200 have longitudinal ribs 210, which are inserted in a slot made with a corresponding negative shape in the wall structure 300 in the form of a tongue-and-groove joint.

In addition, the housing sections 200 have curved circumferential ribs 220 which run in circumferential slots made with a corresponding negative shape in the wall structure, although this is not shown in the figure.

The embodiment described allows easy replacement of the annular combustion chamber lining, i.e. the housing composed of a number of housing sections, without the need to open up the outer housing, i.e. the wall structure 30. The housing is dismantled by dismantling the inner housing 260 surrounding an individual combustion chamber and then pulling the housing sections 210 out of the aforementioned slots. This is particularly easy to do because the housing consists of a number of housing sections 200 that are guided out of, or into, the correspondingly shaped slots in the wall structure 300, preferably in pairs, during dismantling or assembly respectively. In this embodiment, the housing of the combustion chamber according to the invention composed of a plurality of housing sections 200 is held in a self-supporting arrangement so that it can be dismantled easily as described.

The invention claimed is:

1. A combustion chamber comprising:

an outer wall structure surrounding an internal area;

a cooling air inlet orifice arranged on the outer wall structure for cooling air near a hot gas outlet orifice, the cooling air inlet orifice opening into a cooling air channel;

a burner projecting into the internal area;

a housing extending from the burner to the hot gas outlet orifice;

a stiffening rib arranged on a surface of the housing and oriented in an axial direction in the direction of hot gas flow, the stiffening rib sized and configured to reduce stress in the housing;

an inner wall offset from the outer wall structure, the inner wall formed by a surface of the housing and cooled by convection by an air stream flowing between the outer wall structure and the inner wall, the air stream being conducted in a closed cooling air channel; and an outlet opening for the cooling air from the cooling air channel via which the cooling air is conducted to the burner for combustion purposes, whereby between the cooling air inlet orifice and the outlet opening the majority of the surface of the housing is cooled by convection by the cooling air stream;

an interlocking joint comprising a flange of the housing proximate the hot outlet orifice extending into a slot formed in the outer wall structure, the interlocking joint providing positional support for the housing within the outer wall structure while allowing both axial and radial thermal growth there between; and a suspension device comprising a plurality of fixing elements each urging the housing radially toward the outer wall structure under a spring tension to provide a rest position for the housing within the outer wall structure, each fixing element comprising a bolt passing through a respective conical shaped guide hole compromising a narrowing diameter formed through the outer wall structure effective to create a rubbing by the respective bolt against the respective narrowing during operation of the combustion chamber thereby suppressing unwanted vibration of the housing.

2. The combustion chamber as claimed in claim 1, wherein the housing is made of sheet metal having a wall thickness between 3 mm and 10 mm.

3. The combustion chamber as claimed in claim 2, wherein the wall structure has at least one cooling air inlet orifice in the area of the hot gas outlet orifice.

4. The combustion chamber as claimed in claim 1, wherein the housing has stiffening ribs on its outer surface.

5. The combustion chamber as claimed in claim 1, wherein in the area of the burner the housing has a device for insertion of the burner.

6. The combustion chamber as claimed in claim 1, wherein the fixing elements are spring mounted at the end adjoining the wall structure.

7. The combustion chamber as claimed in claim 1, wherein the suspension device is designed such that the suspended housing can move both axially and radially with respect to an axis extending in a lengthwise direction of the combustion chamber.

8. The combustion chamber as claimed in claim 1, wherein each of the fixing element bolts have at a first end an essentially hemispherical bolt head that is seated so as to allow tilting in a recess in a bolt holder mounted on the housing end, said recess being essentially hemispherical in cross-sectional view.

9. The combustion chamber as claimed in claim 8, wherein the second end of each bolt is fed through the respective guide hole in the wall structure and through a compression spring on the outer side of the wall structure, the compression spring being compressed against the outer side of the wall structure by means of a washer held at the second end of the bolt.

10. The combustion chamber as claimed in claim 1, wherein the housing is split in one sectional plane.

11. The combustion chamber as claimed in claim 1, wherein the cooling air inlet orifice is sized and configured to reduce impingement cooling and enhance convective cooling.

12. The combustion chamber as claimed in claim 11, wherein the axial length of cooling air inlet orifices is less that 50% of the total axial length of the housing.

13. The combustion chamber as claimed in claim 12, wherein the axial length of the cooling air inlet orifices is less that 20% of the total axial length of the housing.

14. The combustion chamber as claimed in claim 13, wherein a single cooling air inlet orifice is located in each portion of the housing split in one sectional plane.

15. The combustion chamber as claimed in claim 11, wherein two cooling air inlet orifices provide the cooling air.

16. A combustion chamber comprising:

an outer wall structure surrounding an internal combustion area;

a cooling air inlet orifice arranged adjacent to an interlocking joint on the outer wall structure such that where cooling air enters a cooling air channel, a section of a housing is cooled by impingement cooling and the housing extends from the burner to the hot gas outlet orifice;

a burner projecting into the internal combustion area;

an inner wall offset from the outer wall structure, the inner wall formed by a surface of the housing and cooled by convection by an air stream flowing between the outer wall structure and the inner wall, the air stream being conducted in a closed cooling air channel; and an outlet opening for the cooling air from the cooling air channel via which the cooling air is conducted to the burner for combustion purposes, whereby between the cooling air inlet orifice and the outlet opening the majority of the surface of the housing is cooled by convection by the cooling air stream;

the housing supported in a rest position within the outer wall structure by a plurality of fixing elements urging the housing toward the outer wall structure in spring tension and by an interlocking joint comprising a flange of the housing extending into a slot formed in the outer wall structure, the interlocking joint providing positional support for the housing proximate a hot gas outlet orifice while allowing both axial and radial thermal growth there between;

each fixing element compromising a bolt passing through a respective conical shaped guide hole compromising a narrowing diameter formed through the outer wall structure effective to create a rubbing by the respective bolt against the respective narrowing during operation of the combustion chamber thereby suppressing unwanted vibration of the housing.

* * * * *